United States Patent [19]

Norimatsu et al.

[11] 4,106,450

[45] Aug. 15, 1978

[54] AIR-TO-FUEL RATIO FEEDBACK CONTROL SYSTEM

[75] Inventors: Hideaki Norimatsu; Mitsuo Nakamura, both of Kariya; Nobuyuki Kobayashi, Toyota, all of Japan

[73] Assignees: Nippondenso Co., Ltd., Kariya; Toyota Jidosha Kogyo Kabushiki Kaisha, Toyota, both of Japan

[21] Appl. No.: 786,898

[22] Filed: Apr. 12, 1977

[30] Foreign Application Priority Data

Jul. 2, 1976 [JP] Japan ..... 51-79096

[51] Int. Cl.[2] ..... F02B 33/00

[52] U.S. Cl. ..... 123/119 EC; 123/32 EE; 60/285

[58] Field of Search ..... 123/119 EC, 32 EC, 32 EA, 123/32 EE; 60/276, 285

[56] References Cited

U.S. PATENT DOCUMENTS

| | | | |
|---|---|---|---|
| 3,831,564 | 8/1974 | Schmidt et al. | 60/285 |
| 3,895,611 | 7/1975 | Endo et al. | 123/32 EE |
| 3,931,808 | 1/1976 | Rachel | 123/32 EE |
| 3,990,411 | 11/1976 | Oberstadt et al. | 60/276 |
| 4,029,061 | 6/1977 | Asano | 60/285 |

*Primary Examiner*—Charles J. Myhre
*Assistant Examiner*—R. A. Nelli
*Attorney, Agent, or Firm*—Cushman, Darby & Cushman

[57] ABSTRACT

An air-to-fuel ratio feedback control system which normally functions to correct the air-to-fuel ratio of a mixture supplied to an internal combustion engine to a predetermined air-to-fuel ratio in accordance with an output signal of an air-to-fuel ratio detector disposed in an exhaust passage. The system detects an inoperable period of the air-to-fuel ratio detector due to a low engine temperature and stops the feedback correction of the air-to-fuel ratio to prevent erroneous correction. Furthermore, during the full load operation and idling operation the system holds the feedback correction of the air-to-fuel ratio respectively at a little smaller and larger than the stoichiometric ratio irrespective of the output of the air-to-fuel ratio detector and enables to easily return to substantially the stoichiometric one when the engine operating condition returns to normal operation.

8 Claims, 2 Drawing Figures

AIR-TO-FUEL RATIO FEEDBACK CONTROL SYSTEM

BACKGROUND OF THE INVENTION

This invention relates to an air-to-fuel feedback control system wherein the air-to-fuel ratio of the mixture represented by the concentration of oxygen in the exhaust gases from an internal combustion engine, is fed back to correct the air-to-fuel ratio of the mixture.

Heretofore, it has been proposed to detect and feed back the oxygen content of the exhaust gases from an internal combustion engine to correct the air-to-fuel ratio of the mixture and thereby reduce the emissions of harmful constituents in the exhaust gases, and this control through the feedback system is particularly advantageous in that the air-to-fuel ratio can be controlled at the desired value against considerably large variations in the external conditions, e.g., variations in the atmospheric pressure, variations in the intake air temperature, etc. However, the air-to-fuel ratio detectors used for this control are of the type whose operating conditions change with temperature, and particularly when the temperature of exhaust gases is low (lower than about 350° to 400° C), such detector continuously produces a constant output voltage irrespective of the oxygen content changes in the exhaust gases. Consequently, it is undesirable to effect feedback correction of the air-to-fuel ratio of the mixture in accordance with the output voltage of the detector which is produced during such inoperable period.

SUMMARY OF THE INVENTION

It is the object of the invention to provide an improved air-to-fuel ratio feedback control system which overcomes the foregoing deficiency.

In accordance with the present invention, the inoperable condition of the air-to-fuel ratio detector is monitored and discriminated in accordance with the duration of its constant level output voltage, and the result of this discrimination is stored in accordance with a particular operating condition of an internal combustion engine, whereby when the air-to-furl ratio detector is in the inoperable condition, the feedback correction of the air-to-fuel ratio is stopped to prevent erroneous feedback correction of the air-to-fuel ratio.

The operating conditions of the air-to-fuel ratio detector can also accurately be monitored and discriminated under certain operating conditions of the engine, such as, during full load operation, idling operation, etc., where the air-to-fuel ratio of the mixtures becomes independent of the operating conditions of the air-to-fuel ratio detector.

DESCRIPTION OF THE PREFERRED EMBODIMENTS

Figure 1:
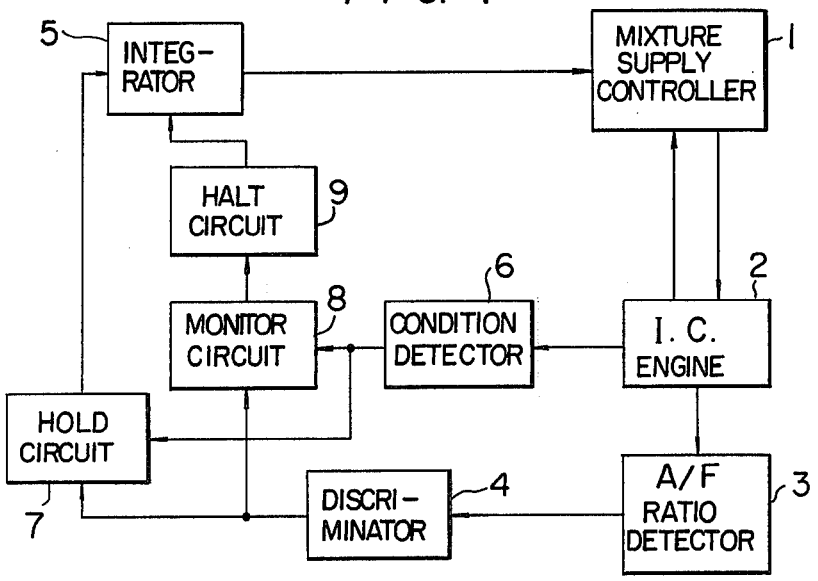
FIG. 1 is a block diagram showing the general construction of an air-to-fuel ratio feedback control system according to the invention.

The present invention will now be described with reference to the illustrated embodiment. Referring to FIG. 1, a mixture supply controller 1 includes a known type of means, such as, a carburetor or electronicallycontrolled fuel injection system for supplying a mixture of air and fuel into the intake system of an internal combustion engine 2, and this means has a predetermined air-fuel ratio characteristic to provide the proper mixture to suit the operating conditions of the engine. An air-to-fuel ratio detector 3 which is positioned in the exhaust system of the engine 2, is of a known type which produces an output voltage of step characteristic corresponding to the oxygen content of the exhaust gases at elevated temperatures of higher than about 350° to 400° C. The feedback system for feeding back the output voltage of the air-to-fuel ratio detector 3 from the exhaust system of the engine 2 to the mixture supply controller 1 in the engine intake system, comprises a discriminator circuit 4 for comparing the output voltage of the air-to-fuel ratio detector 3 with a preset desired value to determine whether the air-to-fuel ratio is greater or smaller than the desired value, and an integrator circuit 5 for integrating the output voltage of the discriminator circuit 4 to produce an integration signal having a variation characteristic corresponding to the voltage level thereof. Additionally connected to the feedback system are a condition detector circuit 6 for detecting predetermined operating conditions of the engine 2, a hold circuit 7 which is controlled by the condition detector circuit 6 to prevent the application of the output voltage of the discriminator circuit 4 to the integrator circuit 5 to hold the existing integration voltage, a monitor circuit 8 for monitoring the air-to-fuel ratio detector 3 for its inoperable condition in accordance with the duration of the output voltage of the discriminator circuit 4, and a halt circuit 9 whereby in response to the detection by the monitor circuit 8 of the inoperable condition of the air-to-fuel ratio detector 3, the integration voltage from the integrator circuit 5 is controlled at a predetermined constant value and stop the correction of the air-to-fuel ratio in the mixture supply controller 1. The condition detector circuit 6 is connected to the monitor circuit 8, and the monitor circuit 8 is responsive to the output of the condition detector circuit 6 to store and hold the then current operating condition of the air-to-fuel ratio detector 3.

Figure 2:
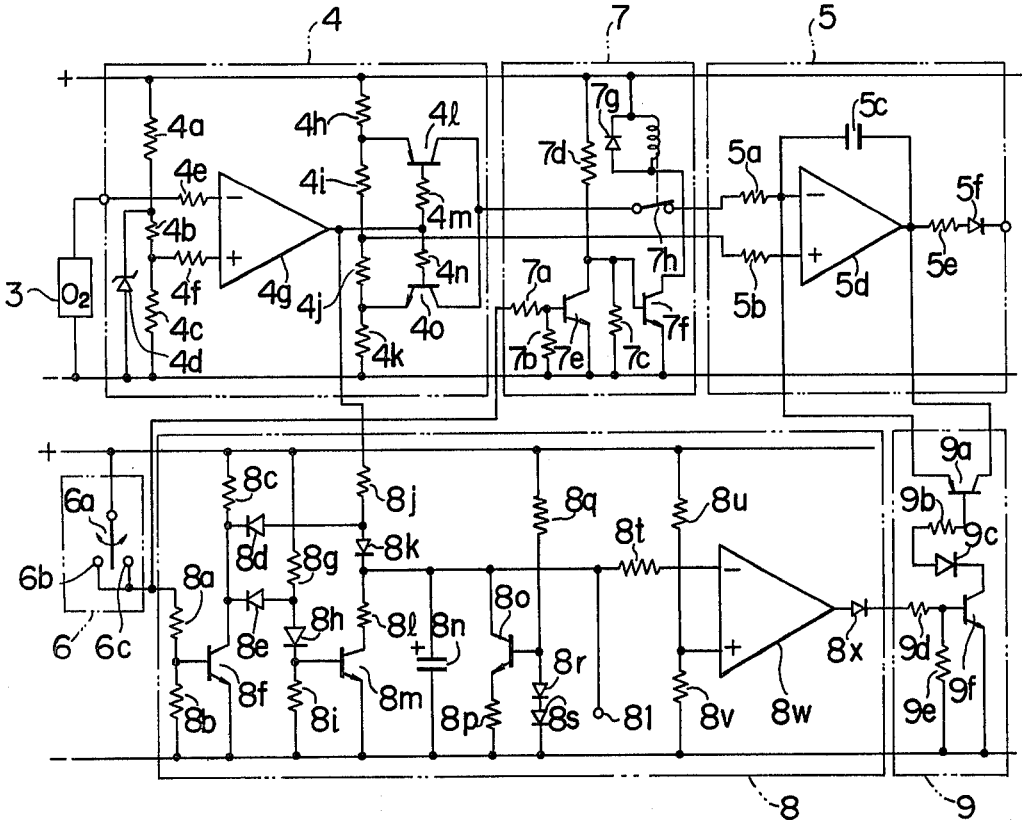
FIG. 2 is a wiring diagram showing a detailed construction of the principal parts of the system according to the invention.

Next, the feedback system will be described in greater detail with reference to FIG. 2. The discriminator circuit 4 comprises resistors *4a, 4b, 4c, 4e, 4f, 4h, 4i, 4j, 4k, 4m* and *4n*, a Zener diode *4d*, a comparator *4g* and transistors *4l* and *4o*, and the comparator *4g* receives at its inverting input terminal (−) and noninverting input terminal (+) the output voltage of the air-to-fuel ratio detector 3 and a constant voltage, respectively. The constant voltage is derived by dividing the voltage across the Zener diode *4d* by the resistors *4b* and *4c*. When the output voltage of the air-to-fuel ratio detector 3 is at a low level, the comparator *4g* produces a high level output voltage thereby turning the transistor *4o* on, whereas when the output voltage of the air-to-fuel ratio detector 3 is at a high level, the comparator *4g* produces a low level output voltage thereby turning the transistor *4l* on.

The integrator circuit 5 comprises resistors *5a, 5b* and *5e*, a capacitor *5c*, an amplifier *5d* and a diode *5f*, and the amplifier *5d* receives at its inverting input terminal (−) the collector voltage of the transistors *4l* and *4o* and at its noninverting input terminal (+) a constant voltage $V_B/2$ ($V_B$ is the power supply voltage) provided by the voltage dividing resistors *4h, 4i, 4j* and *4k*. The integrator circuit 5 is designed so that a positive-going integration voltage is produced during the time that the transistor 4*o* remains on, whereas a negative-going integration voltage is produced during the time that the transistor 4*l* remains on.

The condition detector circuit 6 comprises a switch 6*a* adapted to respectively close stationary contacts 6*b* and 6*c* in response to the fully closed and full open positions of the throttle valve of the engine which is not shown, and the condition detector circuit 6 produces a high level voltage only when the throttle valve is in either the fully open position or the fully closed position.

The hold circuit 7 comprises resistors 7*a*, 7*b*, 7*c* and 7*d*, transistors 7*e* and 7*f*, a diode 7*g* and a relay 7*h* whose contacts are closed when energized, whereby when the condition detector circuit 6 produces a high level voltage, the transistors 7*e* and 7*f* are respectively turned on and off, and the contacts of the relay 7*h* are opened, thus preventing the collector voltage of the transistors 4*l* and 4*o* in the discriminator circuit 4 from being applied to the integrator circuit 5. When this occurs, the integration voltage of the integrator circuit 5 is no longer changed and held at the value attained just before the inhibition of the input.

The monitor circuit 8 comprises resistors 8*a*, 8*b*, 8*c*, 8*g*, 8*i*, 8*j*, 8*l*, 8*p*, 8*q*, 8*t*, 8*u* and 8*v*, diodes 8*d*, 8*e*, 8*h*, 8*k*, 8*r*, 8*s* and 8*x*, transistors 8*f*, 8*m* and 8*o*, a capacitor 8*n* and a comparator 8*w*, and the output terminal of the comparator 4*g* in the discriminator circuit 4 is connected to the capacitor 8*n* through the resistor 8*j* and the diode 8*k*.

The halt circuit 9 comprises transistors 9*a* and 9*f*, resistors 9*b*, 9*d* and 9*e* and a diode 9*c*, and the capacitor 5*c* of the integrator circuit 5 is discharged when the transistors 9*a* and 9*f* are turned on. When this occurs, the integration voltage of the integrator circuit 5 is forcibly maintained at the predetermined voltage $V_B/2$ which is constantly applied to the noninverting terminal (+) of the amplifier 5*d*.

With the construction described above, the system of this invention operates as follows. The air-to-fuel ratio characteristic of the mixture supply controller 1 is adjusted by the conventional method in such a manner that as for example, the mixture with an air-to-fuel ratio greater than the stoichiometric ratio is supplied during the idling operation of the engine 2 where the throttle valve is fully closed, while the mixture with an air-to-fuel ratio smaller than the stoichiometric ratio is supplied during the full load operation where the throttle valve is fully opened, and the air-to-fuel ratio of the mixture is corrected in accordance with the difference between the integration voltage from the integrator circuit 5 and the constant voltage $V_B/2$.

The air-to-fuel ratio detector 3 is designed so that when its temperature is low as during the engine starting period, the detector 3 presents a high impedance and produces a constant output voltage irrespective of the oxygen content of the exhaust gases as mentioned previously, and its voltage level is high indicating that the air-to-fuel ratio of the mixture is smaller than the stoichiometric ratio. Consequently, the comparator 4*g* of the discriminator circuit 4 produces a low level voltage so that in the monitor circuit 8 the capacitor 8*n* is not charged, and the inverting input voltage of the comparator 8*w* remains below the constant voltage produced by the dividing resistors 8*u* and 8*v*, thus causing the comparator 8*w* to produce a high level voltage. This high level voltage is indicative of the inoperable condition of the air-to-fuel ratio detector 3, so that in response to this voltage the transistors 9*a* and 9*c* of the halt circuit 9 are turned on, and thus the integration voltage produced from the integration circuit 5 is maintained at the constant voltage $V_B/2$. Consequently, no correction of the air-to-fuel ratio is performed in the mixture supply controller 1, and the mixture produced by the mixture supply controller 1 in accordance with the predetermined air-to-fuel ratio characteristic is supplied to the engine 2. This operation prevents any erroneous feedback correction of the air-to-fuel ratio.

When the temperature of the air-to-fuel ratio detector 3 rises thus rendering it operable to detect the air-to-fuel ratio, the air-to-fuel ratio detector 3 produces an output voltage corresponding to the oxygen content of the exhaust gases so that a low level output voltage is produced when oxygen is present in the exhaust gases (when the air-to-fuel ratio of the mixture is greater than the stoichiometric ratio), while a high level output voltage is produced when oxygen is not present in the exhaust gases (when the air-to-fuel ratio of the mixture is smaller than the stoichiometric ratio). Thus, the comparator 4*g* of the discriminator circuit 4 produces either a low level output voltage or a high level output voltage depending on the output voltage level of the air-to-fuel ratio detector 3, and as long as a high level voltage is not produced from the condition detector circuit 6, the output voltage of the comparator 4*g* is applied through the relay 7*h* of the hold circuit 7 to the integrator circuit 5 which in turn integrates the input voltage in either the positive-going direction or the negative-going direction. On the other hand, when the temperature of the air-to-fuel ratio detector 3 rises and its output voltage changes from the high level to the low level, the comparator 4*g* of the discriminator circuit 4 produces a high level voltage so that the capacitor 8*n* of the monitor circuit 8 is charged through the resistor 8*j* and the diode 8*k*, and the voltage across the capacitor 8*n* exceeds the constant noninverting input voltage of the comparator 8*w*, thus causing the output voltage of the comparator 8*w* to go to the low level. In response to this low level voltage, the transistors 9*a* and 9*f* of the halt circuit 9 are turned off, and the integration circuit 5 produces the previously mentioned integration voltage which either increases or decreases.

Consequently, the feedback correction of the air-to-fuel ratio is no longer inhibited so that the mixture supply controller 1 corrects the air-to-fuel ratio of the mixture toward the stoichiometric ratio in accordance with the integration voltage, and the output voltage of the air-to-fuel ratio detector 3 changes from the high level to the low level and vice versa in short cycles by virtue of the feedback correction. The comparator 4*g* of the discriminator circuit 4 produces an output voltage which goes to either the high level or the low level in accordance with the output voltage of the air-to-fuel ratio detector 3, so that the capacitor 8*n* of the monitor circuit 8 is charged in response to a high level voltage from the comparator 4*g*, and the capacitor 8*n* is discharged in response to a low level voltage from the comparator 4*g*. This discharge is effected through the transistors 8*m* and 8*o*, and the voltage across the capacitor 8*n* decreases with the discharge time. However, since the output voltage of the air-to-fuel ratio detector 3 changes in short cycles as mentioned previously, the voltage across the capacitor 8*n* of the monitor circuit 8 is not caused to become lower than the noninverting input voltage of the comparator 8*w*, and the feedback correction of the air-to-fuel ratio is accomplished.

With the feedback correction of the air-to-fuel ratio being effected, when the throttle valve of the engine 2 is moved to the fully open position or the fully closed position, the switch 6a of the condition detector circuit 6 closes the contacts 6b or the contacts 6c, and thus the transistors 8f and 8m of the monitor circuit 8 are respectively turned on and off, thereby inhibiting the charging of the capacitor 8n as well as its discharge through the transistor 8m. Consequently, the capacitor 8n is discharged only through the transistor 8o, with the result that the comparator 8w continues to produce and hold a low level voltage for a considerable period of time, and the feedback correction is not stopped upon movement of the throttle valve to the fully open position or the fully closed position. When the throttle valve is fully opened or closed fully, the transistors 7e and 7f of the hold circuit 7 are respectively turned on and off, thus preventing the application of the output voltage of the discriminator circuit 4 to the integrator circuit 5. As a result, the integrator circuit 5 holds the integration voltage existing at the time that the throttle valve is moved to the fully open position or the fully closed position, and the mixture supply controller 1 corrects the air-to-fuel ratio of the mixture in accordance with the thus maintained integration voltage. The advantage of holding the integration voltage in this way resides in that as for example, the mixture with an air-to-fuel ratio smaller than the stoichiometric ratio is supplied when the throttle valve is in the fully open position and the mixture with a ratio greater than the stoichiometric one is supplied when the throttle valve is in the fully closed position, whereas the air-to-fuel ratio of the mixture is returned to around the stoichiometric ratio upon movement of the throttle valve from the fully open position or the fully closed position to the normal opening.

On the other hand, the capacitor 8n of the monitor circuit 8 continuously discharges through the transistor 8o during the time that the feedback correction of the air-to-fuel ratio is maintained by holding the integration voltage, so that when the time interval during which the throttle valve is in the fully open position or the fully closed position lasts long (e.g., about 4 seconds), the comparator 8w produces a high level voltage, and the transistors 9a and 9f of the halt circuit 9 are turned on, thus effecting a change from the correction holding mode to the correction halting mode. A transition from the correction halting mode to the correction holding mode is effected in the similar manner as the previously mentioned transition of the air-to-fuel ratio detector 3 from the inoperable condition to the operable condition.

When the air-to-fuel ratio detector 3 is cooled rapidly and thus rendered inoperable during the time that the feedback correction of the air-to-fuel ratio is being effected, its output voltage is held at the high level as mentioned previously, and the comparator 4g of the discriminator circuit 4 continuously produces a low level output voltage, thus preventing the capacitor 8n of the monitor circuit 8 from being charged. Consequently, in response to the high level voltage from the monitor circuit 8, the halt circuit 9 comes into operation and stops the feedback correction. If, in this condition, the throttle valve is moved to the fully open position or the fully closed position thus causing the hold circuit 7 to come into operation, by virtue of the fact that the halt circuit 9 controls the integration voltage at the constant voltage $V_B/2$ which provides zero correction, the holding of the feedback correction as required when the air-to-fuel ratio detector 3 is in operation is not accomplished When the throttle valve is removed from the fully open position or the fully closed position, the low level output voltage of the discriminator circuit 4 is applied through the hold circuit 7 to the integration circuit 5 which in turn integrates the input voltage in the direction of decrease. On the other hand, when the throttle valve is in the fully open position or the fully closed position, the transistors 8f and 8m of the monitor circuit 8 are respectively turned on and off, so that the capacitor 8n slightly discharges only through the transistor 8o, and the comparator 8w continuously produces a high level voltage. As a result, if the time interval during which the throttle valve is in the fully open position or the fully closed position is short, even after the removal of the throttle valve to the normal opening, the comparator 8w of the monitor circuit 8 holds its high level voltage so that the integrator circuit 5 does not produce a negative-going integration voltage in response to the high level output voltage produced during the inoperable period of the air-to-fuel ratio detector 3, and the feedback correction is continuously halted. Thus, by virtue of the fact that the inoperable condition of the air-to-fuel ratio detector 3 is stored when the throttle valve is in the fully open position or the fully closed position, even after the removal of the throttle valve to the normal opening, the feedback correction of the air-to-fuel ratio is still halted, thus preventing any erroneous feedback correction of the air-to-fuel ratio during the inoperable period of the air-to-fuel ratio detector 3.

In the above-described embodiment, when the time interval during which the throttle valve is in the fully open position or the fully closed position is longer than a predetermined time, the air-to-fuel ratio correction holding mode is switched to the correction halting mode, because the capacitor 5c of the integrator circuit 5 gradually discharges during the correction holding period and thus the integration voltage is changed. Further, the holding of the feedback correction may be accomplished in response to any condition other than the fully open position or the fully closed position of the throttle valve, and moreover by applying a low level voltage to a terminal 8' of the monitor circuit 8 in accordance with an engine condition such as the engine speed, it is possible to halt the feedback correction by the monitor circuit 8 according to the engine condition.

What is claimed is:

1. An air-to-fuel ratio feedback control system for internal combustion engines comprising:

an air-to-fuel ratio detector, positioned in an exhaust passage of an engine, for generating a detection signal indicative of the air-to-fuel ratio of air-fuel mixture supplied to said engine;

a discriminator, connected to said air-to-fuel ratio detector, for generating a discrimination signal which changes to high and low levels alternately in response to said detection signal;

an integrator, connected to said discriminator, for generating an integration signal the level of which increases or decreases in response to said discrimination signal;

a mixture controller, adapted to supply said engine with air-fuel mixture of air-to-fuel ratio which is preset to vary in accordance with engine operating conditions and connected to said integrator, for correcting said air-to-fuel ratio to a constant ratio which is substantially equal to the stoichiometric ratio in response to said integration signal;

a condition detector for generating a condition signal when the throttle valve of said engine is fully closed and when fully opened;

a monitor circuit, connected to said discriminator and said condition detector, for generating a monitor signal indicative of at least one of conditions in which an alternately changing interval of said discrimination signals exceeds a first predetermined interval and a generation interval of said condition signals exceeds a second predetermined interval longer than said first predetermined interval; and a halt circuit, connected to said monitor circuit, for causing said integrator to maintain said integration signal to a constant level in response to said monitor signal, said constant level being predetermined to indicate that air-to-fuel ratio correction in said mixture controller is stopped.

2. An air-to-fuel ratio feedback control system as claimed in claim 1, wherein said monitor circuit includes:

a capacitor;

a charging circuit, connected in series between said discriminator and said capacitor, for charging said capacitor while said discrimination signal remains one level between high and low levels;

a discharging circuit, connected in parallel with said capacitor while said discrimination signal remains the other level between high and low levels;

a discharge control circuit, connected between said condition detector and said discharging circuit, for lowering the discharging rate of said capacitor in response to said condition signal; and a comparator, connected to said capacitor, for comparing the voltage across said capacitor with a constant voltage to generate said monitor signal.

3. An air-to-fuel ratio feedback control system as claimed in claim 1 further comprising:

a hold circuit, connected in series between said discriminator and said integrator, for cutting off said discrimination signal in response to said condition signal applied from said condition detector.

4. An air-to-fuel ratio feedback control system as claimed in claim 3, wherein said hold circuit includes:

a switch adapted to open in response to said condition signal for cutting off said discrimination signal.

5. In combination with an engine system, wherein air-to-fuel mixture of air-to-fuel ratios preset to vary in accordance with operating conditions of an engine is suppled to said engine and exhaust gas corresponding to said air-fuel mixture is emitted from said engine, a feedback control system comprising:

an oxygen sensor for detecting the presence and the absence of the oxygen in said exhaust gas;

an integrator, connected to said oxygen sensor, for integrating an input signal to generate an integration signal which alternately increases and decreases in response to the alternate detection of the presence and the absence of said oxygen;

a mixture supply controller, connected to said integrator, for correcting said preset air-to-fuel ratios of said air-to-fuel mixture to the stoichiometric ratio in response to said integration signal;

a condition detector for generating a condition signal while said engine is in a preselected operating condition;

a monitor circuit, connected to said oxygen sensor and said condition detector, for generating a monitor signal either while the interval of detection of the presence and the absence of said oxygen exceeds a first constant interval or while the interval of generation of said condition signal exceeds a second constant interval longer than said first constant interval; and a halt circuit, connected to said monitor circuit, for preventing said integrator from integrating said input signal in response to said monitor signal, said integration signal being controlled to a constant level in response to which said mixture controller stops correction of said air-to-fuel ratio of said air-fuel mixture while said monitor signal is generated.

6. A feedback control system as claimed in claim 5, wherein said monitor circuit includes:

a capacitor;

a charging circuit, connected in series with said capacitor, for charging said capacitor while one of said presence and said absence of oxygen is detected;

a discharging circuit, connected in parallel with said capacitor, for discharging said capacitor while the other of said presence and said absence is detected;

a discharge control circuit, connected between said condition detector and said discharging circuit, for lowering the discharging rate of said capacitor in response to said condition signal; and a comparator, connected to said capacitor, for comparing the voltage across said capacitor with a constant voltage to generate said monitor signal.

7. A feedback control system as claimed in claim 5 further comprising:

a hold circuit, connected to said condition detector, for cutting off said input signal of said integrator in response to said condition signal to thereby hold said integration signal at the level which is generated when said condition signal is generated.

8. A feedback control system as claimed in claim 5, wherein said condition detector includes:

a switch for generating said condition signal while the throttle valve of said engine is fully closed and opened.

* * * * *